US008287394B2

(12) United States Patent
Gil et al.

(10) Patent No.: US 8,287,394 B2
(45) Date of Patent: Oct. 16, 2012

(54) SEAT ASSEMBLY SUCH AS FOR AN AMUSEMENT RIDE

(75) Inventors: Alex L. Gil, Toronto (CA); Michael Berinde, Richmond Hill (CA)

(73) Assignee: Simex Inc., Toronto, Ontario (CA)

( * ) Notice: Subject to any disclaimer, the term of this patent is extended or adjusted under 35 U.S.C. 154(b) by 172 days.

(21) Appl. No.: 12/751,207

(22) Filed: Mar. 31, 2010

(65) Prior Publication Data

US 2011/0062755 A1 Mar. 17, 2011

(30) Foreign Application Priority Data

Sep. 14, 2009 (CA) ..... 2678573

(51) Int. Cl.
*A63G 31/12* (2006.01)
*A63G 31/04* (2006.01)

(52) U.S. Cl. ..... 472/59; 472/130; 434/55

(58) Field of Classification Search ..... 472/59–61, 472/130, 134, 135; 434/29, 55; 104/53, 104/85

See application file for complete search history.

(56) References Cited

U.S. PATENT DOCUMENTS

| | | | | |
|---|---|---|---|---|
| 5,022,708 | A | 6/1991 | Nordella et al. | |
| 5,597,359 | A | 1/1997 | Byerly | |
| 5,678,889 | A | 10/1997 | Purcell, Jr. | |
| 5,885,080 | A | 3/1999 | Letovsky | |
| 5,901,612 | A | 5/1999 | Letovsky | |
| 5,954,508 | A | 9/1999 | Lo et al. | |
| 5,980,255 | A | 11/1999 | Mathieu et al. | |
| 6,053,576 | A | 4/2000 | Jessee | |
| 6,113,500 | A | 9/2000 | Francis et al. | |
| 6,152,828 | A | 11/2000 | Tomita et al. | |
| 6,162,058 | A | 12/2000 | Yang | |
| 6,224,380 | B1 | 5/2001 | Lo et al. | |
| 6,413,090 | B1 | 7/2002 | Shiina et al. | |
| 6,431,989 | B1 | 8/2002 | Katayama et al. | |
| 6,533,670 | B1 * | 3/2003 | Drobnis | 472/60 |
| 6,733,293 | B2 | 5/2004 | Forster et al. | |
| 7,094,157 | B2 | 8/2006 | Fromyer et al. | |
| 7,437,998 | B2 * | 10/2008 | Burger et al. | 104/73 |
| 2005/0048446 | A1 | 3/2005 | Fromyer et al. | |
| 2006/0135271 | A1 | 6/2006 | Casey et al. | |

FOREIGN PATENT DOCUMENTS

| | | | |
|---|---|---|---|
| CN | 2009622993 | Y | 10/2007 |
| FR | 2696859 | A1 | 4/1994 |
| WO | 95/05223 | A1 | 2/1995 |
| WO | 2005/009790 | A1 | 2/2005 |

OTHER PUBLICATIONS

Search Report issued on corresponding application No. 201002867-8 in Singapore.

* cited by examiner

*Primary Examiner* — Kien Nguyen
(74) *Attorney, Agent, or Firm* — Bereskin & Parr/S.E.N.C.R.L., s.r.l.

(57) ABSTRACT

A seat assembly comprises a plurality of stabilizing members mounted to a base. A passenger support member is moveably mounted along the plurality of stabilizing members. A plurality of spaced apart inflatable actuators are drivingly connected to the passenger support member.

20 Claims, 9 Drawing Sheets

SEAT ASSEMBLY SUCH AS FOR AN AMUSEMENT RIDE

CROSS-REFERENCES TO RELATED APPLICATIONS

This application claims priority from Canadian Patent Application 2,678,573, filed on Sep. 14, 2009, the entirety of which is incorporated herein by reference.

FIELD

The disclosure relates to a seat assembly. In one preferred embodiment, the disclosure relates to a seat assembly for a motion simulator, and a method for operating such a seat assembly.

INTRODUCTION

The following is not an admission that anything discussed below is prior art or part of the common general knowledge of persons skilled in the art.

Simulators typically comprise a screen on which an image is projected and a plurality of seats that are mounted on a platform that is moveably mounted to a base. Typically, a plurality of hydraulically operated telescoping cylinders is used to move the seats in a defined pattern.

More recently, U.S. Pat. No. 7,094,157 (Fromyer et al.) discloses a pneumatic motion platform. As stated therein, the pneumatic motion platform is adapted to allow an open center to handle shear stress without the need for a central support. In an embodiment, the platform comprises a deck; a base; a plurality of inflatable actuators, each actuator attached to the deck at a predetermined location intermediate the base and the deck, the plurality of inflatable actuators adapted for use as an active motive force with respect to the deck in a plurality of planes; a plurality of compliant stabilizers disposed intermediate the deck and the base, at least one portion of each stabilizer disposed proximate a predetermined one of the plurality of inflatable actuators; a fluid controller in fluid communication with the plurality of inflatable actuators; and a source of fluid in fluid communication with the fluid controller. A ride vehicle may comprise a cabin attached to a deck attached to the motion platform attached to a rotator such as a turntable.

SUMMARY

The following summary is provided to introduce the reader to the more detailed discussion to follow. The summary is not intended to limit or define the claims.

According to one aspect, a seat assembly is provided. The seat assembly has at least one seat, and preferably a plurality of seats, and utilizes inflatable actuators to provide the motive force for the seats. The inflatable actuators may provide movement in one, or more than one, direction. The inflatable actuators may be the sole motive producing force and may support the full weight of the seats and the passengers during at least some of a ride. In addition, the seat assembly is provided with a mechanical linkage between a base and the seats. The mechanical linkage may provide one or more functions. In one embodiment, the mechanical linkage provides a track along which the seats, or a platform on which the seats are mounted, may travel. Alternately, or in addition, the mechanical linkage may limit the movement of the seats.

According to this aspect, a seat assembly is provided. The seat assembly comprises a plurality of stabilizing members mounted to a base. A passenger support member is moveably mounted along the plurality of stabilizing members. A plurality of spaced apart inflatable actuators are drivingly connected to the passenger support member.

The passenger support member may be slideably mounted to the plurality of stabilizing members.

The plurality of stabilizing members may comprise a plurality of generally vertically extending members. The plurality of stabilizing members may be rigid, and may comprise a plurality of rods.

At least some of the inflatable actuators may be selectively connectable to a pressure source. The plurality of spaced apart inflatable actuators may comprise a plurality of forward inflatable actuators selectively connectable to the pressure source and a plurality of rearward inflatable actuators selectively connectable to the pressure source The pressure source may comprise a reserve tank that is selectively connectable to the inflatable actuators by a plurality of valve assemblies. The valve assemblies may be operatively controlled by a controller, and the controller may be programmed to produce a rate of acceleration of the passenger support member that is based on a predetermined estimated weight of passengers supported by the passenger support member.

The plurality of spaced apart inflatable actuators may comprise at least one forward inflatable actuator and at least one rearward inflatable actuator. The inflatable actuators may be inflatable to different degrees to alter the pitch of the passenger support member.

Each of the plurality of stabilizing members may be rotatably mounted to the base about a generally horizontal axis.

The seat assembly may further comprise a plurality of mounting assemblies movably mounting the passenger support member along at least some of the stabilizing members. The mounting assemblies may comprise a bearing that is slidably mounted to a stabilizing member. The stabilizing member may extend through the bearing. At least some of the bearings may be spherical bearings.

The seat assembly may further comprise a vertical travel limiter secured to the base at a fixed distance from the base. The vertical travel limiter may comprise a stop plate provided on at least one stabilizing member.

The passenger support member may comprise a generally horizontally extending platform to which a plurality of seats are mounted.

The stabilizing members may or may not be configured to allow roll motion of the passenger support member.

Each stabilizing member may be positioned adjacent at least one of the inflatable actuators. Each stabilizing member may be individually coupled to the passenger support member.

The plurality of inflatable actuators may comprise four inflatable actuators, and the plurality of stabilizing members comprises four stabilizing members.

According to another aspect, a method of operating a seat assembly is provided. The seat assembly comprises a base having a plurality of stabilizing members mounted thereto, and a passenger support member moveably mounted with respect to the base. The method comprises varying a level of inflation of a plurality of inflatable actuators that are drivingly connected to the passenger support member, and causing the passenger support member to travel along the plurality of stabilizing members.

The method may further comprise inflating a first set of the inflatable actuators to change a pitch of the passenger support member, and rotating the stabilizing member about a generally horizontal axis as the pitch of the passenger support member changes.

The method may further comprise determining a predetermined load of the passenger support member and determining a maximum inflation rate for the inflatable actuators based on the predetermined load.

DRAWINGS

The drawings included herewith are for illustrating various examples of articles, methods, and apparatuses of the present specification and are not intended to limit the scope of what is taught in any way. In the drawings.

Figure 1:
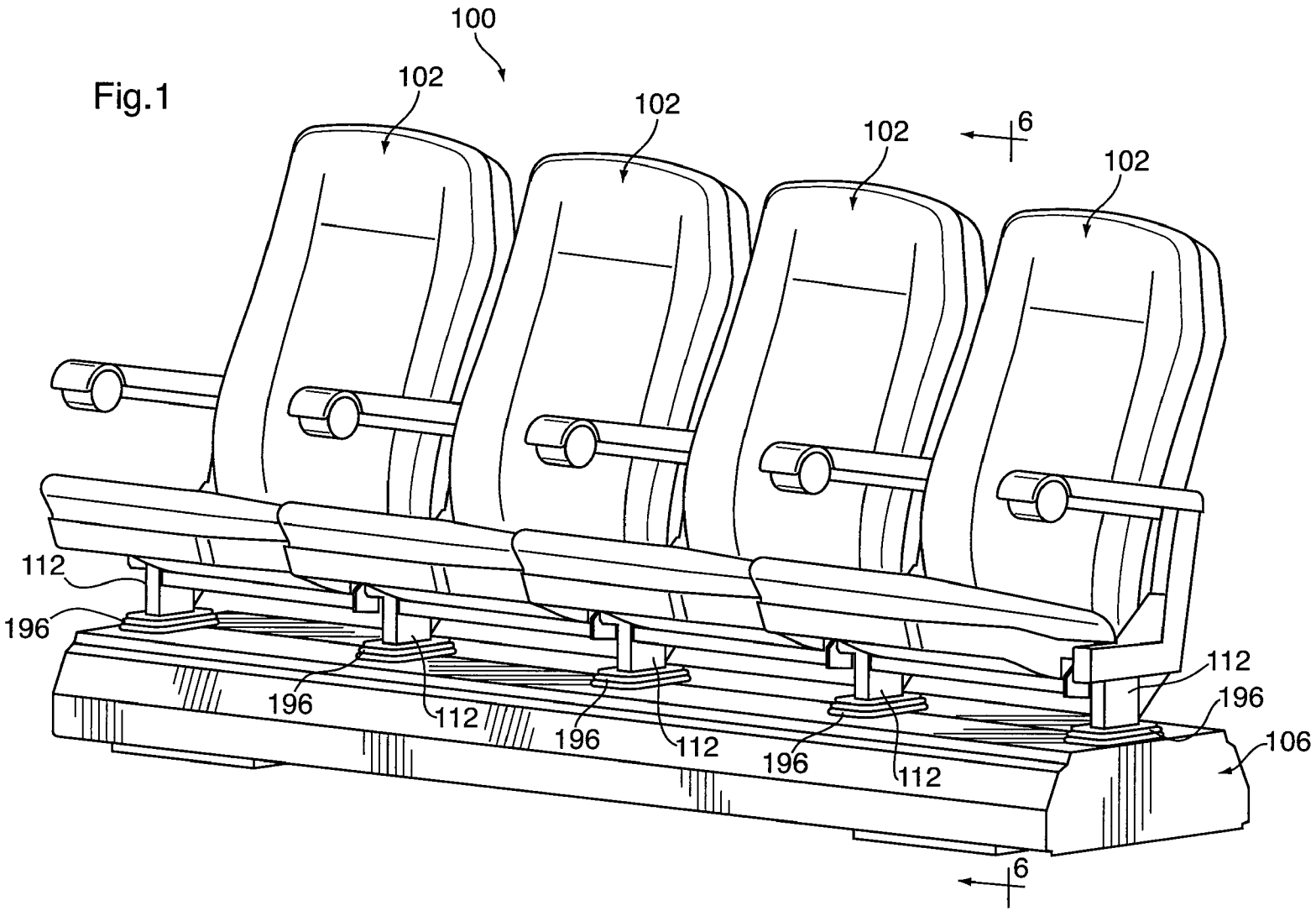
FIG. 1 is a perspective illustration of a seat assembly.
Figure 2:
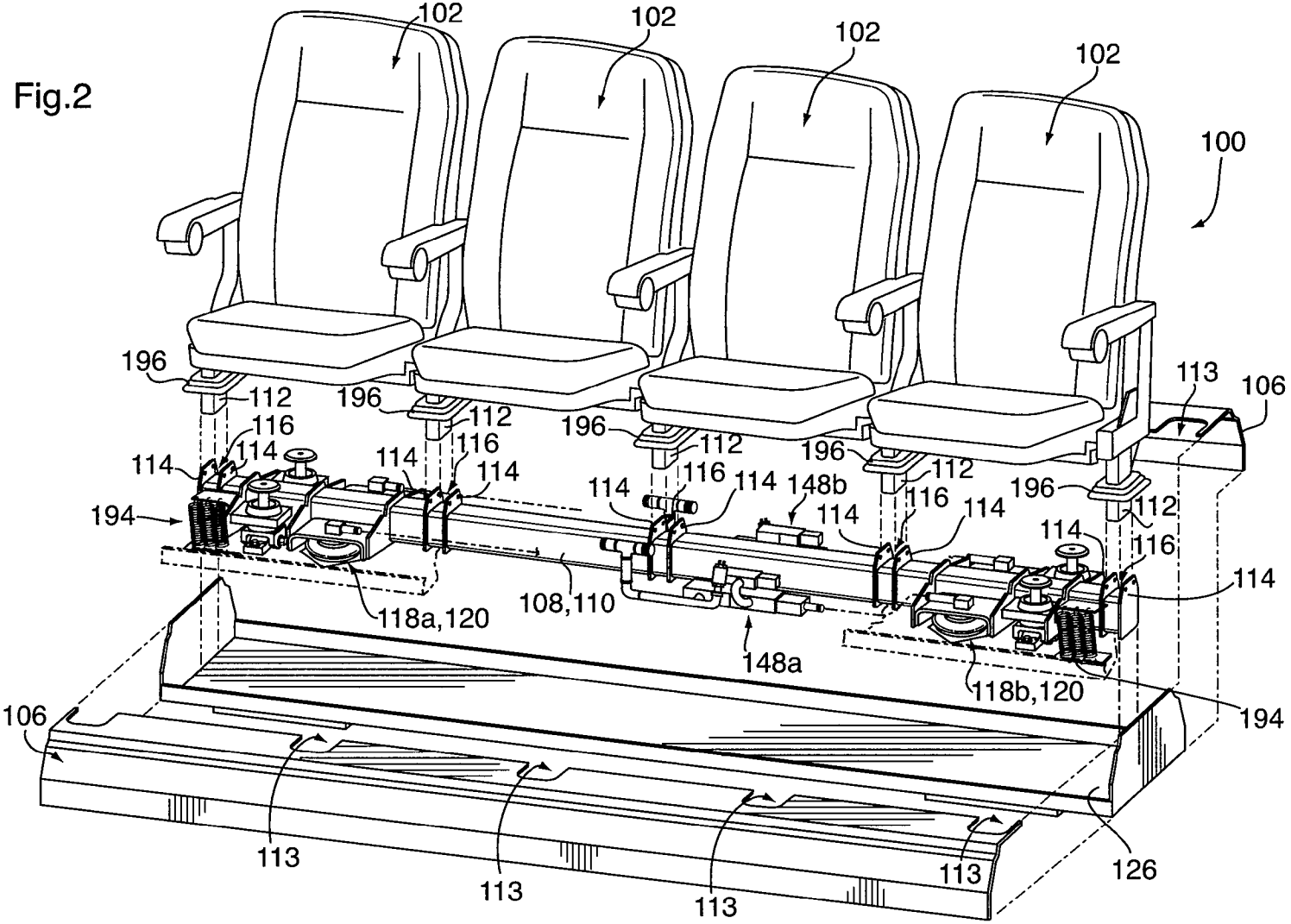
FIG. 2 is an exploded view of the seat assembly of FIG. 1.
Figure 2A:
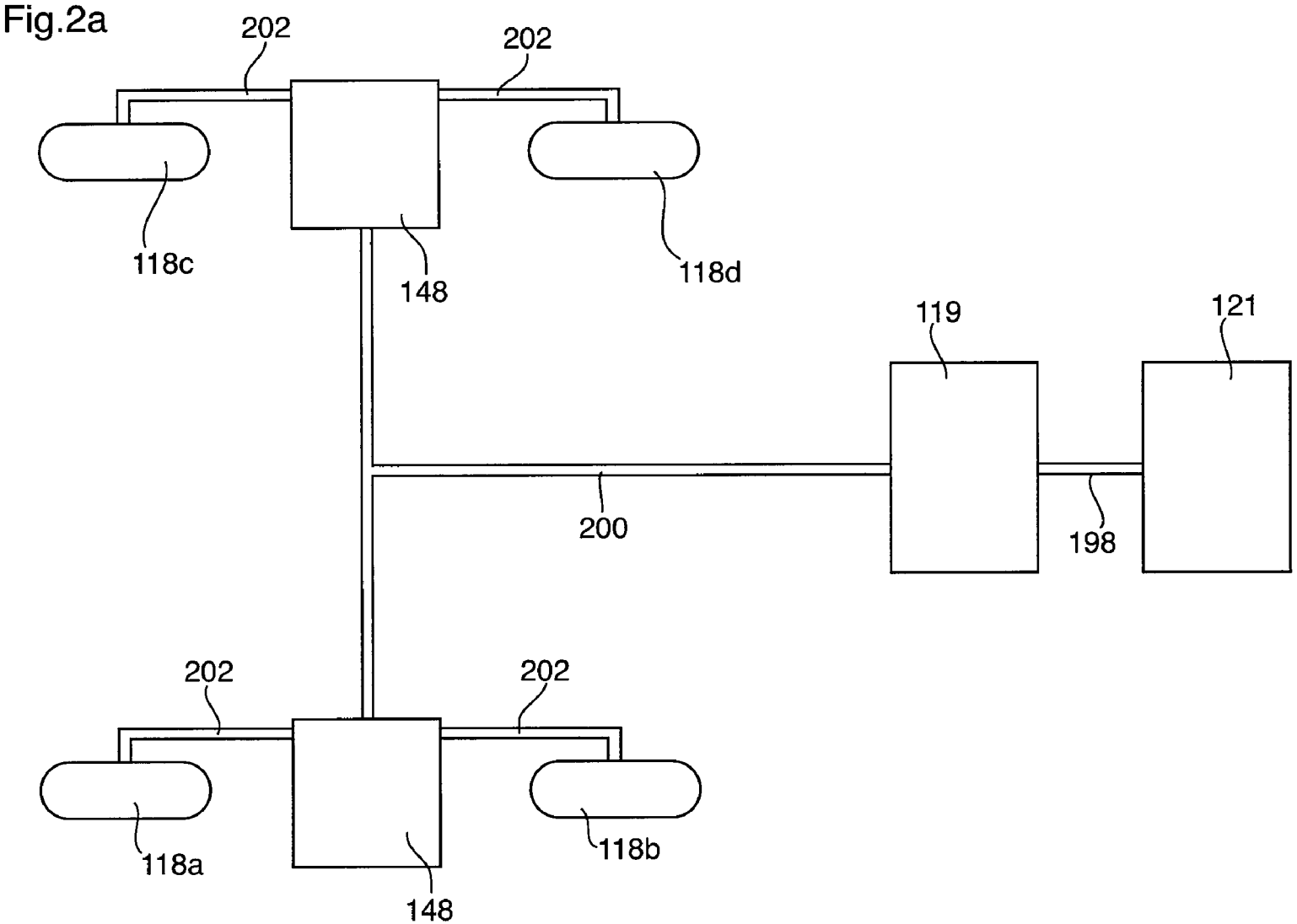
Figure 3:
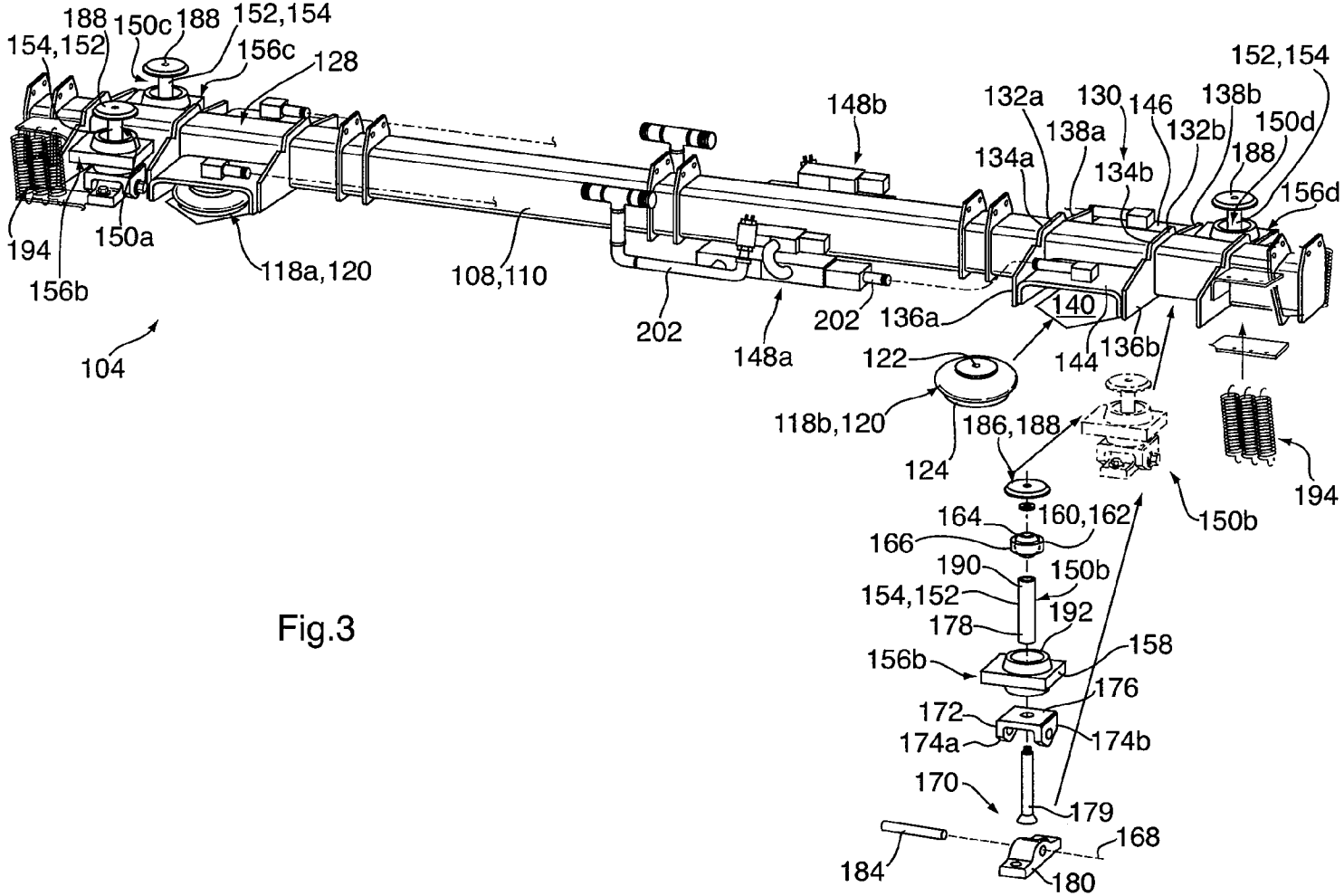
Figure 5:
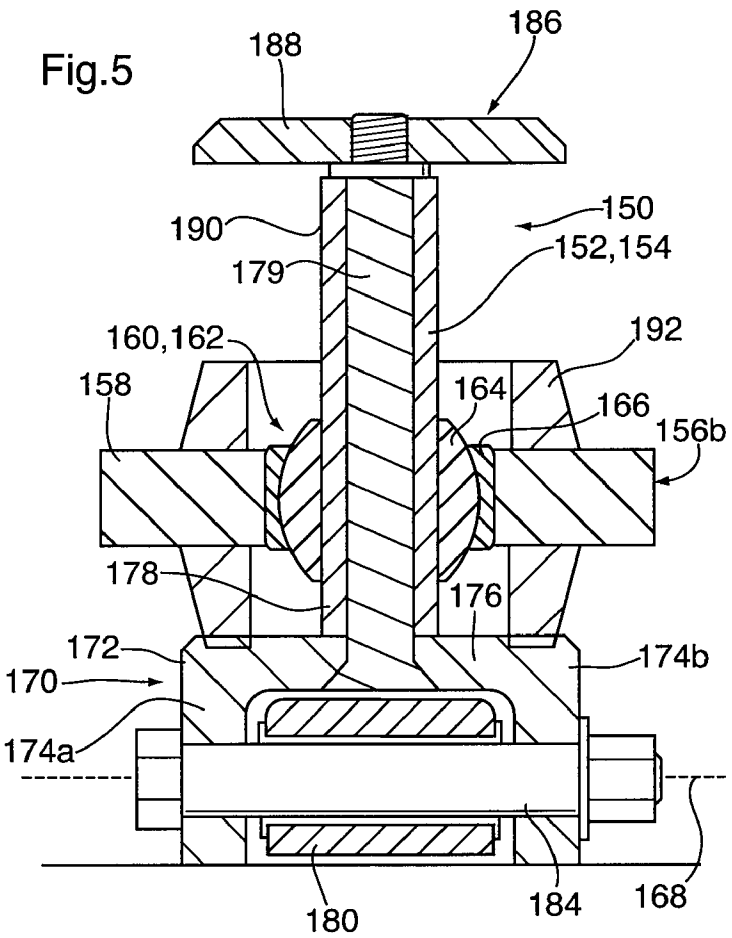
Figure 4:
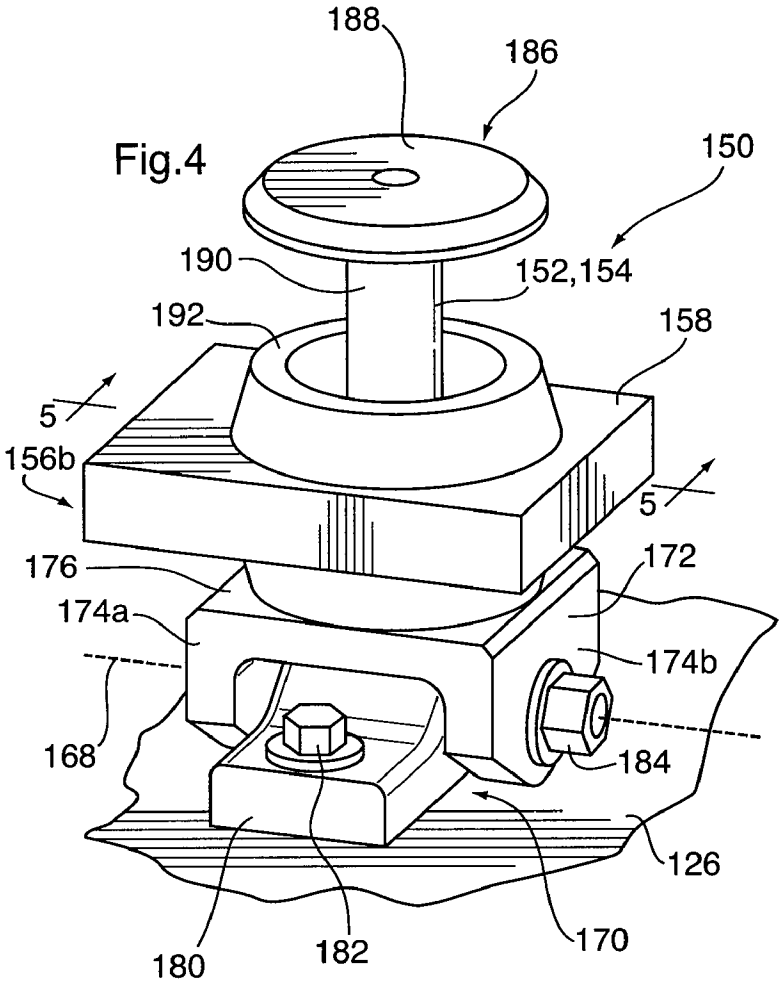
Figure 6:
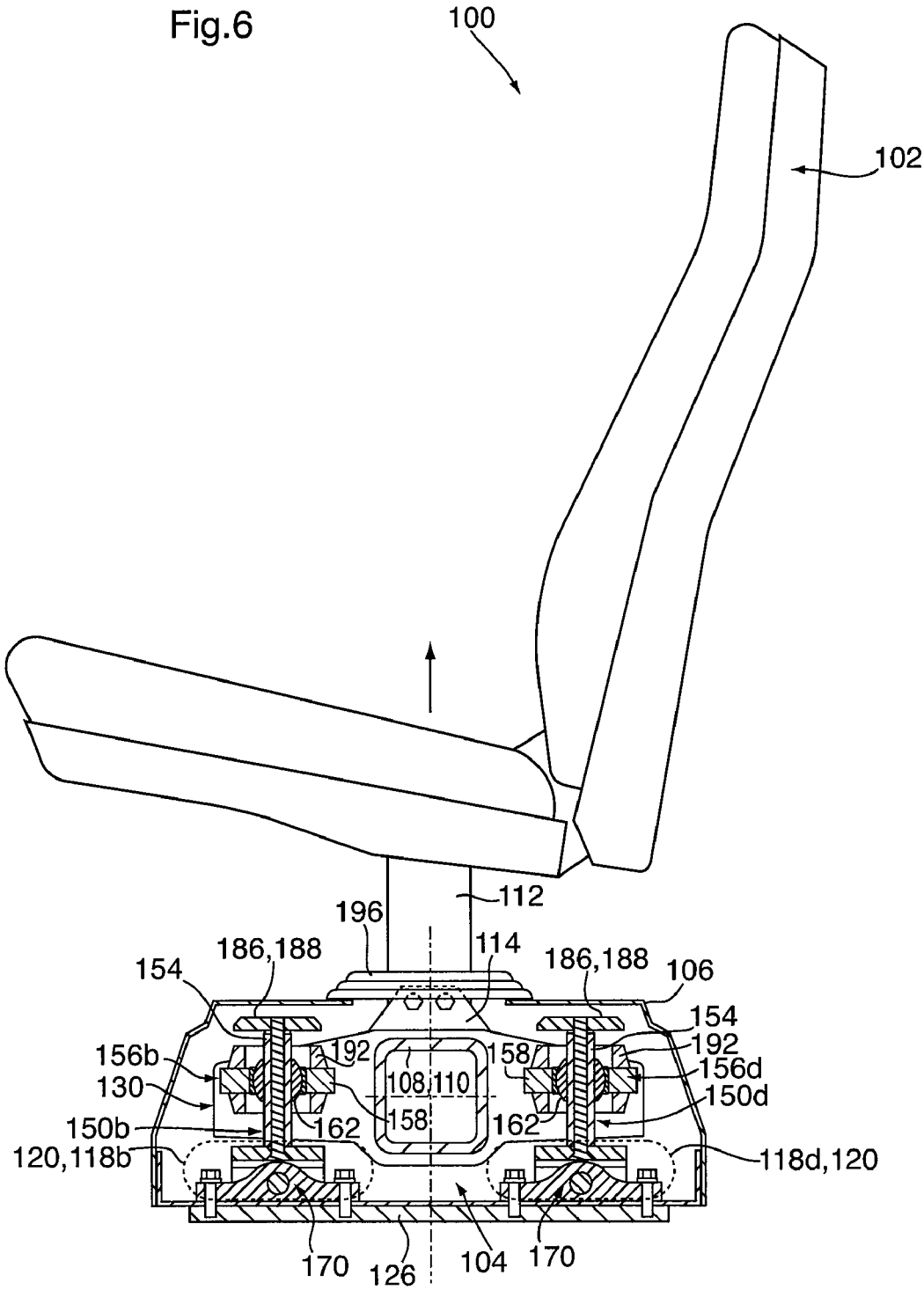
Figure 7:
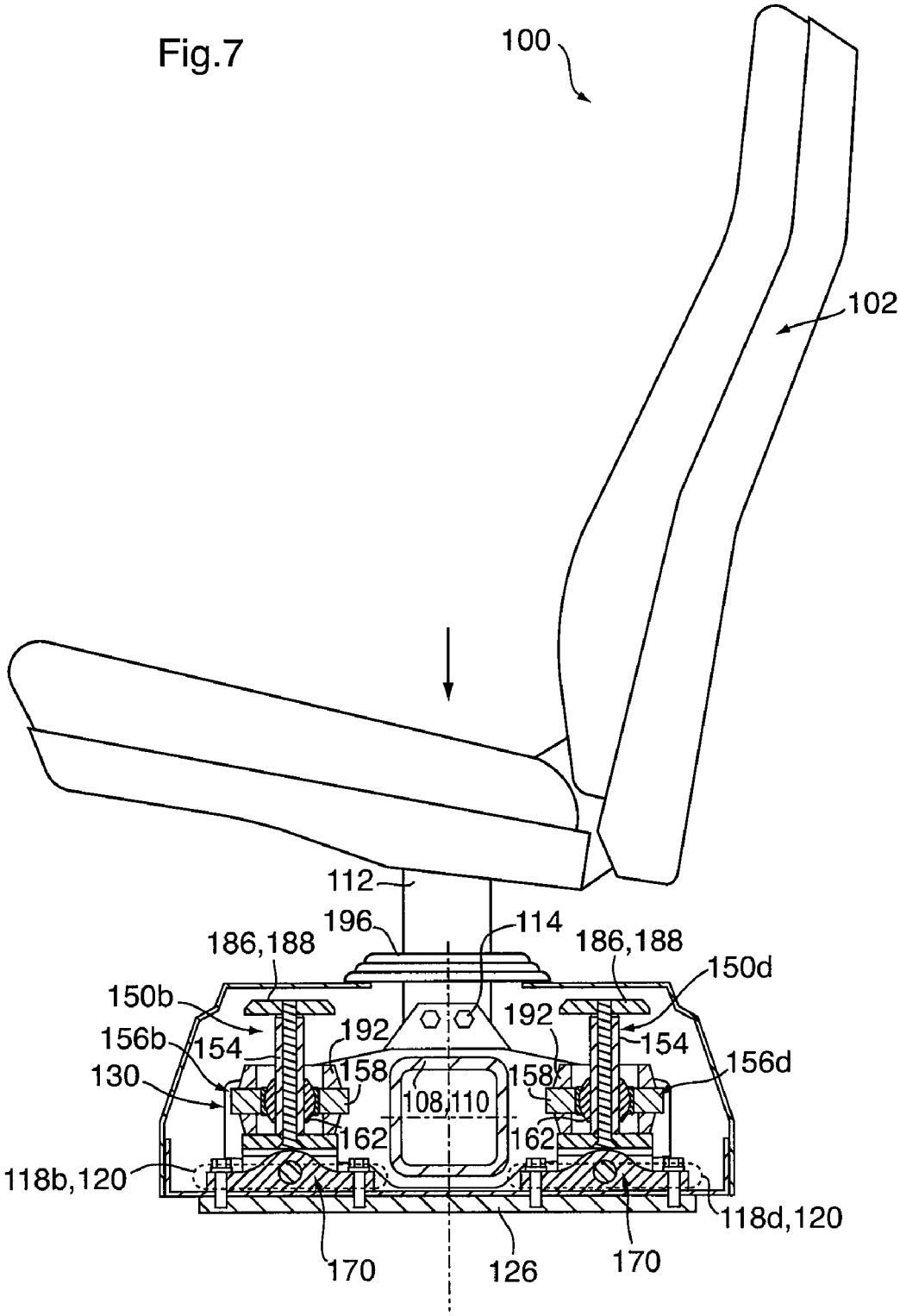
Figure 8:
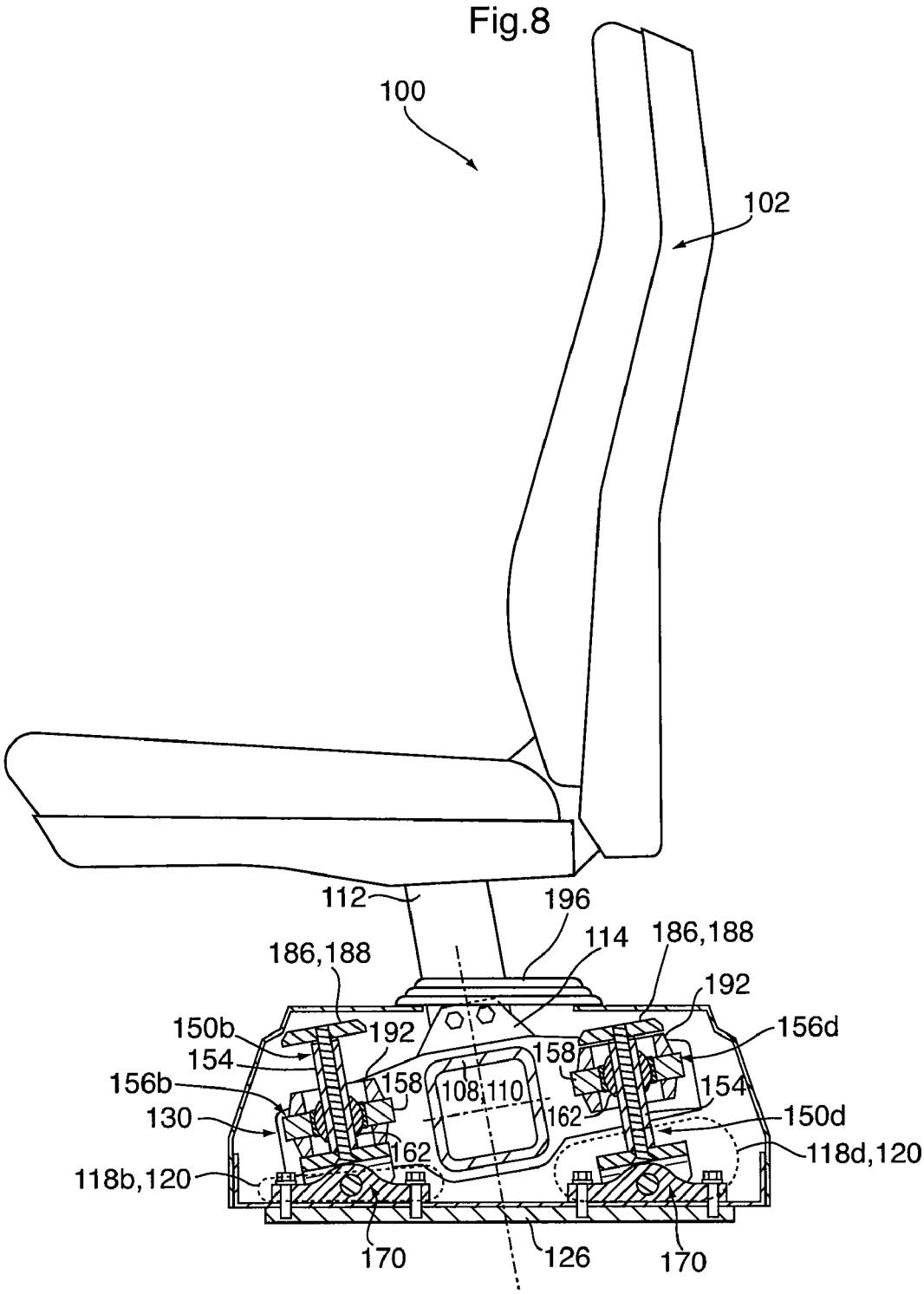
Figure 9:
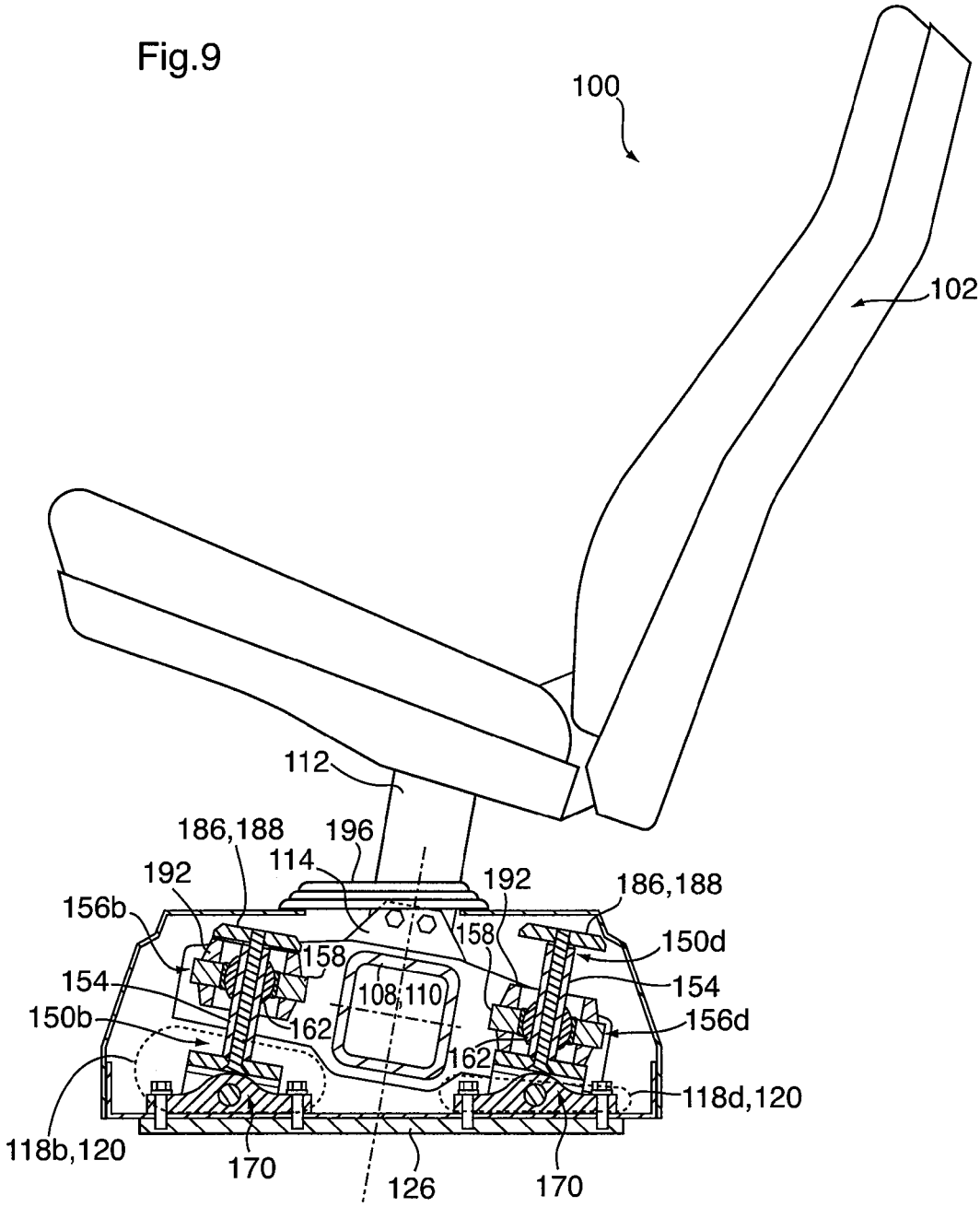

FIG. 2*a* is a schematic illustration showing a pressure source in communication with the seat assembly;

FIG. 3 is an exploded view of the motion assembly of FIG. 2;

FIG. 4 is perspective illustration of the stabilizing member of FIG. 3;

FIG. 5 is a cross-section taken along line 5-5 in FIG. 4;

FIG. 6 is a cross-section taken along line 6-6 in FIG. 1, showing the seat assembly is a raised position;

FIG. 7 is a cross-section taken along line 6-6 in FIG. 1, showing the seat assembly is a lowered position;

FIG. 8 is a cross-section taken along line 6-6 in FIG. 1, showing the seat assembly is a pitched forward position; and FIG. 9 is a cross-section taken along line 6-6 in FIG. 1, showing the seat assembly is a pitched rearward position.

DETAILED DESCRIPTION

Various apparatuses or methods will be described below to provide an example of each claimed invention. No example described below limits any claimed invention and any claimed invention may cover processes or apparatuses that are not described below. The claimed inventions are not limited to apparatuses or processes having all of the features of any one apparatus or process described below or to features common to multiple or all of the apparatuses described below. It is possible that an apparatus or process described below is not an embodiment of any claimed invention.

Referring to FIG. 1, a seat assembly 100 is shown. The seat assembly 100 may be part of an amusement ride, for example a motion simulator type ride. In such a ride, one or more passengers may sit in the seat assembly 100, and the seat assembly 100 may impart motion to the one or more passengers. In the example shown, the seat assembly 100 is configured to be in a passive motion simulator type ride. In such passive motion simulator type rides, the movement of the seats is synchronous with a visual display. For example, the one or more passengers may view a video, and if the video shows a vehicle going over a bump, the seat assembly may move the one or more passengers up and down. In alternate examples, the seat assembly may be configured to be in an active motion simulator type ride. In such examples, the one or more passengers may control their movement. Such systems may include, for example, flight simulators. In yet further alternate examples, the seat assembly may be part of another suitable type of ride, such as a roller coaster, or a sightseeing train.

Referring still to FIG. 1, in the example shown, the seat assembly 100 comprises a plurality of seats 102, which are arranged in a row. In alternate examples, the seats 102 may be arranged in another suitable configuration, such as a grid. In further alternate examples, the seat assembly may comprise only one seat, which may seat only one passenger, or more than one passengers (e.g., the seat assembly may comprise a bench). In yet further alternate examples, the seat assembly may not comprise any seats, and may, for example, comprise a platform upon which one or more passengers may stand.

Referring to FIGS. 1 and 2, the seats 102 are mounted to a motion assembly 104, which is optionally housed in a casing 106. The motion assembly 104 imparts motion to the seats 102, as will be described further hereinbelow. Referring to FIG. 2, the motion assembly 104 comprises a passenger support member 108. The passenger support member supports the weight of the passengers and is acted upon by inflatable actuators.

In the example shown, the passenger support member 108 indirectly supports the passengers. That is, the passenger support member 108 supports the seats 102, and the seats 102 support the passengers. Preferably, the passenger support member comprises a generally horizontally extending platform, such as a beam 110. Seats 102 may be mounted thereto by any means known in the art. As exemplified, a plurality of legs 112 are mounted to the seats 102, preferably between each seat 102, and at the end of each row. The legs 112 extend through apertures 113 provided in the front and rear sections of casing 106, and are mounted to the beam 110, such that the seats 102 are supported by the beam 110. Specifically, in the example shown, the beam 110 is provided with a plurality of optional brackets 114, which define slots 116 between a pair of adjacent brackets 114, into which the legs 112 may be inserted. The legs 112 may then be secured in the slots, for example using one or more screws (not shown) that may extend through holes provided in brackets 114 and into legs 112. Brackets 114 may be secured to beam 110 by any means known in the art. For example, a bracket 114 may be secured to the beam by providing a hole in bracket 114 through which beam 110 may extend, by welding, by rivets or the like. In alternate examples, the legs 112 may be secured to the beam 110 in another manner, or may be integral with the beam 110. In a further alternate example, the seats 102 may be secured directly to beam 110.

Referring still to FIG. 2, the apertures 113 are preferably oversized (i.e. are larger in cross sectional area than the legs), such that as motion is imparted to the passenger support member to tilt the seats 102, the legs 112 may tilt within the apertures 113. More preferably, a plurality of optional bellows 196 are provided, which surround the legs 112 adjacent the oversized apertures 113. The bellows 196 function to cover the aperture.

In alternate examples, the passenger support member 108 may directly support the passengers. For example, as mentioned hereinabove, the seat assembly 100 may not comprise any seats, and may, for example, comprise a platform upon which one or more passengers may stand. In such examples, the platform may be the passenger support member 108. It will be appreciated that various other structures used for rides may be used.

Referring now to FIG. 3, the motion assembly 104 further comprises a plurality of spaced apart inflatable actuators 118, which are drivingly connected to the passenger support member 108. The inflatable actuators preferably comprise at least one, and more preferably a plurality of forward inflatable actuators (i.e. positioned forwardly of the passenger support member 108), and preferably at least one, and more preferably a plurality of rearward inflatable actuators (i.e. positioned rearwardly of the passenger support member 108). In the example shown, first 118*a*, second 118*b*, third 118*c* (shown in FIG. 2*a*), and fourth 118*d* (shown in FIGS. 6 to 9)

inflatable actuators are provided. The first 118*a* and second 118*b* inflatable actuators are forward inflatable actuators, and are positioned on opposed laterally spaced apart side portions of the passenger support member 108. The third 118*c* and fourth 118*d* inflatable actuators are rearward inflatable actuators, and are also positioned on opposed laterally spaced apart side portions of the passenger support member 108, such that the third 118*c* and fourth 118*d* inflatable actuators are aligned with the first 118*a* and second 118*b* inflatable actuators.

It will be appreciated that any number of inflatable actuators 118 may be provided and they may be positioned at any desired location. Preferably, as exemplified, the inflatable actuators are provided, at least in part, in pairs of forward and rearward inflatable actuators 118.

Referring still to FIG. 3, the inflatable actuators 118 are inflatable or deflatable to impart motion to the passenger support member 108, and thereby impart motion to the seats 102. In the example shown, the inflatable actuators 118 each comprise an airbag 120, having a top portion 122, and a bottom portion 124 (shown only on the second airbag 118*b* in FIG. 3). The bottom portion 124 of each inflatable actuator 118 may be mounted to a base 126 (shown in FIG. 2). For example, as shown, the base 126 is provided by the casing 106, to which the bottom portion 124 is mounted. In alternate examples, the bottom portion 124 may be mounted directly to the floor or ground, or to another suitable base. The top portion 122 of each inflatable actuator 118 may be mounted to the passenger support member 108. For example, as shown, a pair of mounts 128, 130 are mounted to the passenger support member 108, on opposed side portions of the passenger support member 108. The mount 130 comprises a first arm 132*a* and a second arm 132*b* spaced from the first arm 132*a*. Each arm 132*a*, 132*b* comprises a central portion 134*a*, 134*b*, which is received on the beam 110, a forwardly extending portion 136*a*, 136*b*, and a rearwardly extending portion 138*a*, 138*b*. The forwardly extending portions 136*a*, 136*b* cooperate to define a forward recess 140, and the rearwardly extending portions 138*a*, 138*b* cooperate to define a rearward recess (not shown). A forward plate 144 is mounted to the forwardly extending portions 136*a*, 136*b*, in the forward recess 140. Similarly, a rearward plate 146 is mounted to the rearwardly extending portions 138*a*, 138*b*, in the rearward recess. The second inflatable actuator 118*b* is positioned beneath the forward plate 144, in the forward recess 140, and the top portion 122 of the first airbag 118*a* is secured to the forward plate 144. The fourth inflatable actuator 118*d* is positioned beneath the rearward plate 146, in the rearward recess, and the top portion of the fourth airbag 118*d* is secured to the rearward plate 146. The mount 128 is of a similar configuration to the mount 130, and will not be described in detail herein.

In alternate embodiments, other configurations may be used. For example, mounts 128, 130 may define a volume, which is at least partially enclosed, in which one or more inflatable actuators 118 is positioned. As such, the top and/or the bottom of the inflatable actuators need not be physically connected to a base or the mount.

Referring to FIG. 2*a* at least some of, and preferably each of the inflatable actuators 118 are connectable to a pressure source such that they may be inflated, or deflated, or such that their level of inflation may be varied. The inflatable actuators 118 may be connected to the pressure source in any suitable fashion. The pressure source preferably comprises a reserve tank 119 that is in communication with one or more compressors 121 such as via line 198 and that is selectively connectable to the inflatable actuators 118 by a plurality of valve assemblies 148. One or more lines 200 may extend between reserve tank 119 and valves 148. The valve assemblies 148 may be any suitable valve assemblies, and may be operatively controlled by a controller. Referring to FIGS. 2 to 3, as shown, two valve assemblies 148 are provided. One of the valve assemblies 148*a* is in fluid communication with the forward inflatable actuators 118*a* and 118*b* via one or more lines 202, and the other of the valve assemblies 148*b* is in fluid communication with the rearward inflatable actuators 118*c*, 118*d* via one or more lines 202. Accordingly, the forward inflatable actuators 118*a* and 118*b* are selectively connectable to the pressure source, and the rearward inflatable actuators 118*c*, 118*d* are selectively connectable to the pressure source.

Preferably, the valve assemblies 148 each comprise a combination of digital and analog valves. For example, each valve assembly may comprise three digital valves and one analog valve.

By actuating the valve assemblies 148, the inflatable actuators 118 may be selectively inflated or deflated, or their level of inflation may be varied, to impart motion to the passenger support member 108 and seats 102. For example, referring to FIG. 6, if all of the valve assemblies 148 are actuated such that all of the inflatable actuators 118*a*-118*d* are in communication with the pressure source, all of the inflatable actuators 118 will inflate, and the passenger support member 108 will be raised to impart upward heave motion to the seats 102. Similarly, referring to FIG. 7, if all of the valve assemblies 148 are actuated such that all of the inflatable actuators 118*a*-118*d* are in communication with the surrounding atmosphere (i.e. not in communication with the pressure source), all of the inflatable actuators 118 will deflate, and the passenger support member 108 will be lowered to impart downward heave motion to the seats 102. Alternately, the inflatable actuators 148 may be inflatable to different degrees to alter the pitch of the passenger support member 108 and the seats 102. For example, referring to FIG. 8, the valve assembly 148*b* associated with the rearward inflatable actuators 118*c*, 118*d*, may be actuated such that the rearward inflatable actuators 118*c*, 118*d* are in communication with the pressure source, and the valve assembly 148*a* associated with the forward inflatable actuators 118*a*, 118*b* may be actuated such that the forward inflatable actuators 118*a*, 118*b* are not in communication with the pressure source (e.g., open to the atmosphere). The rearward inflatable actuators 118*c*, 118*d*, will inflate, the forward inflatable actuators 118*a*, 118*b* will not inflate or may deflate, and the passenger support member 108 and seats 102 will be tilted forwards. Alternately, referring to FIG. 9, the valve assembly 148*a* associated with the forward inflatable actuators 118*a*, 118*b*, may be actuated such that the forward inflatable actuators 118*a*, 118*b* are in communication with the pressure source, and the valve assembly 148*b* associated with the rearward inflatable actuators 118*c*, 118*d* may be actuated such that the rearward inflatable actuators 118*c*, 118*d* are not in communication with the pressure source (e.g., open to the atmosphere). The forward inflatable actuators 118*a*, 118*b*, will inflate, the rearward inflatable actuators 118*c*, 118*d* will not inflate or will deflate, and the passenger support member 108 and seats 102 will be tilted backwards.

In the example shown, the inflatable actuators on opposed sides of the passenger support member are not selectively inflatable. That is, the first 118*a* and third 118*c* inflatable actuators are not inflatable independently of the second 118*b* and fourth 118*d* inflatable actuators. However, in alternate examples, each inflatable actuator 118 may be inflatable to different degrees to impart roll motion to the passenger support member 108 and the seats 102. For example, the valve assemblies 148 associated with first 118*a* and third 118*c* inflatable actuators may be opened, and the valve assemblies 148 associated with the second 118*b* and fourth 118*d* inflatable actuators may remain closed. The first 118*a* and third 118*c* inflatable actuators will inflate, the second 118*b* and fourth 118*d* inflatable actuators will not inflate, and roll motion will be imparted to the passenger support member 108 and seats 102. Various other combinations may be used to provide a desired motion.

Preferably, the controller is programmed to produce a rate of acceleration of the passenger support member 108 and seats 102 that is based on a predetermined estimated weight of passengers supported by the passenger support member 108. As exemplified, a set of inflatable actuators 118 may support four seats. The average expected weight of four passengers may then be determined. This weight may be added to the known weight of passenger support member 108 and seats 102 to produce a total mass. A maximum desired acceleration may then be selected. This may be based on the desired severity of the ride. It will be appreciated that if an extreme ride is desired, a higher maximum acceleration may be selected. Once the maximum acceleration is known the inflation rate required to achieve maximum acceleration may be determined by determining the number of actuators to be inflated and the equation force is equal to the mass times the acceleration. The motions provided during a ride may be varied, based upon, e.g., a movie that is projected for the viewers, such that the maximum acceleration is utilized for the most extreme motions.

Referring back to FIG. 3, the seat assembly 100 further comprises a plurality of stabilizing members 150, which are mounted to the base 126, and which may stabilize the motion of the passenger support member 108 as the inflatable actuators 118 are inflated or deflated. As exemplified, the passenger support member 108 is moveably mounted along the plurality of stabilizing members 150, such that as the passenger support member 108 moves up and down in response to the inflation or deflation of the inflatable actuators 118, the passenger support member 108 travels along the stabilizing members 150. Further, as will be described in more detail hereinbelow, in the example shown, as the passenger support member 108 tilts to alter the pitch of the seats 102, the stabilizing members 150 also tilt to accommodate the tilting of the passenger support member 108.

Referring still to FIG. 3, in the example shown, the seat assembly comprises four stabilizing members, including two forwards stabilizing members 150*a*, 150*b*, and two rearward stabilizing members 150*c*, 150*d*. However, in alternate embodiments, another number of stabilizing members 150 may be provided. As shown, each stabilizing member 150 is preferably positioned adjacent one of the inflatable actuators 118. However, in alternate embodiments, the stabilizing members 150 may be positioned elsewhere, for example centered between the inflatable actuators 118.

Referring to FIG. 3, the stabilizing members 150 comprise a plurality of generally vertically extending members 152. As exemplified, each stabilizing member 150 comprises a generally vertically extending member 152. The vertically extending members are preferably rigid, and more preferably, comprise rods 154, along which the passenger support member 108 travels.

As shown, in order to moveably mount the passenger support member 108 along at least some, and preferably all of the rods 154 such that the passenger support member 108 travels along the rods 154, a plurality of mounting assemblies 156 is provided. In the example shown, the mounting assemblies include two forward mounting assemblies 156*a*, 156*b*, and two rearward mounting assemblies 156*c*, 156*d*. Referring to FIGS. 3 to and 5, one of the mounting assemblies 156*b* will presently be described. The other mounting assemblies 156 are preferably identical to the mounting assembly 156 described, and will not be separately described in detail herein.

Referring to FIGS. 3 to 5, the mounting assembly 156*b* comprises a cartridge 158. The cartridge 158 is a generally planar member, which is mounted to the passenger support member 108 and extends outwardly therefrom. For example, the cartridge 158 may be mounted to the passenger support member 108 using one or more fasteners (not shown), or may be integral with the passenger support member 108 or welded thereto. The cartridge comprises a central aperture, extending vertically therethrough. A bearing 160 is received in the central aperture, and is preferably secured therein, for example using a set screw. The bearing 160 is preferably a spherical bearing 162 (otherwise known as a pivoting bearing or a spherical plain bearing). In the example shown, the spherical bearing 162 comprises an inner component 164, and an outer component 166. The outer component 166 is fixedly secured within the central aperture. The inner component 164 is received in the outer component 166, and is able to rotate about a vertical and horizontal axis independent of the outer component 166.

Referring still to FIGS. 3 to 5, the rod 154 extends through the spherical bearing 162, and is slidably mounted thereto. Specifically, the inner component 164 comprises an aperture, which extends longitudinally therethrough. The rod 154 is received in the aperture. Accordingly, as the passenger support member moves up and down, the cartridge moves up and down, and the bearing 162 slides along the rod 154.

Preferably all of the bearings 162 are spherical bearings. However, in alternate embodiments, only one or only some of the bearings may be spherical bearings.

As mentioned hereinabove, in the example shown, as the passenger support member 108 tilts to alter the pitch of the seats 102, the stabilizing members 150 also tilt to accommodate the tilting of the passenger support member 108. In order to tilt, the stabilizing members 150, and more specifically rods 154, are rotatably mounted to the base, 126, about a generally horizontal axis 168. A specific configuration of the mounting of one of the rods 154*b* will presently be described. It will be appreciated that each of the other three rods are preferably mounted in a substantially identical manner to the rod 154 described.

Referring still to FIGS. 3 to 5 a clevis assembly 170 is provided, which rotatably mounts the rod 154 to the base 126. The clevis assembly 170 comprises a shackle 172, which includes first 174*a* and second 174*b* opposed arms, and a platform 176 extending therebetween. A bottom end 178 of the rod 154 is mounted to the platform 176. For example, a fastener 179 may be used to mount the bottom end 178 of the rod 154 to the platform 176. Alternately, the rod 154 may be integral with the platform 176. A pillow block bearing unit 180 is received between the arms 174*a*, 174*b* of the shackle 172, and is secured to the base 126. For example, as shown, bolts 182 (shown in FIG. 4) secure the pillow block bearing unit 180 to the base 126. Optionally, these may extend into a concrete mount or the like provided under, or in lieu of, the base 126. A clevis pin 184 extends between the arms 174*a*, 174*b* of the shackle 172, and through the pillow block bearing unit 180. The shackle 172 and the rod 154 are therefore pivotal about the clevis pin 184.

The extent to which the rod 154 may pivot may vary. In some examples, the clevis assembly 170 may be configured such that rod 154 may pivot by about 10 degrees towards and away from the vertical and preferably 15 degrees.

Accordingly, referring again to FIG. 6, if all of the inflatable actuators 118 are inflated, the passenger support member 108 will raise and impart vertical heave motion to the seats 102. As the passenger support member 108 rises, the mounting assemblies 156 will slide along the rods 154 to stabilize the motion of the passenger support member 108. Similarly, referring to FIG. 7, if all of the inflatable actuators 118 deflate, the passenger support member 108 will drop. As the passenger support member 108 drops, the mounting assemblies 156 will slide along the rods 154 to stabilize the motion of the passenger support member 108. Alternately, referring to FIG. 8, if the rearward inflatable actuators 118*c*, 118*d*, are inflated and the forward inflatable actuators 118*a*, 118*b* are not inflated, the passenger support member 108 and the seats 102 will be tilted forwards (i.e. the pitch of the passenger support member 108 will change). As the passenger support member 108 is tilted forwards, the mounting assemblies 156 will cause the rods 154 to tilt forwards via the clevis assembly 170 and rotate about the axis 168 as the pitch changes. The spherical bearings 162 will accommodate the tilting motion of the rods 154 within the cartridge 158, and allow for smooth motion of the mounting assemblies 156. The rearward mounting assemblies 156*c*, 156*d* will slide along the rearward rods 154, and the forward mounting assemblies 156*a*, 156*b* will generally remain vertically stationary. Similarly, referring to FIG. 9, if the forward inflatable actuators 118*a*, 118*b*, are inflated and the rearward inflatable actuators 118*c*, 118*d* are not inflated, the passenger support member 108 will be tilted rearwards. As the passenger support member 108 is tilted rearwards, the mounting assemblies 156 will cause the rods 154 to tilt rearwards via the clevis assembly 170 and rotate about the axis 168 as the pitch changes. The spherical bearings 162 will accommodate any tilting motion of the rods 154 within the cartridge, and will allow for smooth motion of the mounting assemblies 156. The forwards mounting assemblies 156*a*, 156*b* will slide along the rearward rods 154, and the rearward mounting assemblies 156*c*, 156*d* will generally remain vertically stationary.

As exemplified, it will be appreciates that the passenger support member does not rest upon rod 154. In the lowered position, the passenger support member may rest upon a part of stabilizing member 150, e.g., shackle 172, or it may rest on the base 126 or the inflatable actuator 118 itself. Stabilizing member 150 may utilize a different construction, such as a track or rack and pinion mechanism. Also, if the passenger support member is to have more degrees of freedom, e.g., it may pitch sideways, then an alternate mechanism to shackle 172 and pillow block 180 will be used. Any such mechanism known in the mechanical arts may be used.

It will be appreciated that although FIGS. 6 to 9 show the seats 102 heaved and pitched to their maximum extent, it may be desirable to heave or pitch the seats 102 to less than their maximum extent. For example, all of the inflatable actuators 118 may be fully inflated to heave the seats 102 by two inches, or all of the inflatable actuators 118 may be partially inflated to heave the seats 102 by one inch. Furthermore, it will be appreciated that various movements may be combined. For example, all of the inflatable actuators 118 may be partially inflated to heave the seats 102 by one inch, and the rearward inflatable actuators 118*c*, 118*d* may then be inflated to their maximum extent to pitch the seats 102.

As mentioned hereinabove, in the example shown, the inflatable actuators 118 are not inflatable to different degrees to impart roll motion to the passenger support member 108 and the seats 102. Accordingly, in the example shown, the rods 154 are pivotal about a horizontal axis 168, which extends generally parallel to the passenger support member 108, and are non-pivotal about a horizontal axis which extends generally perpendicular to the passenger support member 108. However, in alternate embodiments, wherein the inflatable actuators 118 are inflatable to different degrees to impart roll motion to the passenger support member 108 and the seats 102, the rods 154 may also be configured to be pivotal about a horizontal axis 168, which extends generally perpendicular to the passenger support member 108.

Referring back to FIGS. 3 to 5, in the example shown, a vertical travel limiter 186 is provided, which is secured to the base 126 at a fixed distance from the base 126. As exemplified, vertical travel limiter 186 comprises a plurality of stop plates 188 which are provided on the stabilizing members 150, and preferably, secured to a top end 190 of the rods 154. Further, a plurality of bumpers 192 may be provided, which may be mounted to the cartridge 158 and may extend vertically outwardly therefrom, and which may surround the rods 154. In use, the vertical travel limiters 186 limit the vertical motion of the cartridge 158 and therefore limit the motion of the passenger support member 108. For example, if the inflatable actuators 118 inflate to impart heave motion to the passenger support member 108 (e.g., maximum acceleration), the passenger support member 108 will rise, and the cartridge 158 will slide upwardly along the rod 154. Eventually, if the inflatable actuators are inflated enough, the bumpers 192 will contact the stop plate 188, and the vertical motion of the cartridge 158 and the passenger support member 108 will stop. The bumpers are preferably resilient and may impart a downward rebound motion to the passenger support member. This rebound motion may be part of the desired motion to be achieved.

Accordingly, the stroke length of the passenger support member 108 may be determined by the vertical travel limiter 186. In some examples, the vertical travel limiter 186 may be configured such that the passenger support member may move up and down by about two inches.

It will be appreciated that it is preferred that at least one of, and optionally both of, the stop plates 188 and the bumpers 192 are cushioned, in order to dampen the impact therebetween.

In alternate examples, the vertical travel limiter may not be provided, and the vertical motion of the cartridge 158 and the passenger support member 108 may be stopped simply by stopping the inflation of the inflatable actuators 118. Alternately, it will be appreciated that plate 188 may be positioned alternately above the maximum extent of travel of cartridge 158, It will be appreciated that alternate travel limiters may be provided, such as a cable extending between the base 126 and the passenger support member 108.

Referring back to FIGS. 2 and 3, in the example shown, the seat assembly 100 further comprises a plurality of optional sets of springs 194. The sets of springs 194 are mounted between the passenger support member 108 and the base 126, and serve to further control the motion of the passenger support member. For example, during loading and unloading of passengers, the seat assembly 100 may be at rest and. As passengers sit in the seats 102 and optionally lean back and move around, the springs prevent, inhibit, or minimize movement of the seats 102. Alternately or in addition, springs 194 may be used to provide a downward force so that, when the inflatable actuators 118 are deflated, the passenger support member 108 is moved downwardly not just by the force of gravity but also by the compressive spring force, thereby enhancing the maximum possible downward acceleration.

In some examples, the seat assembly may further be equipped with one or more special effect devices, such as one or more of a water spray, an air blast, a leg tickle, and seat vibration or any other effect known in the motion simulation industry.

The invention claimed is:

1. A seat assembly comprising:

a. a plurality of stabilizing members mounted to a base;

b. a passenger support member moveably mounted along the plurality of stabilizing members;

c. a plurality of spaced apart inflatable actuators drivingly connected to the passenger support member; and d. a plurality of mounting assemblies movably mounting the passenger support member along at least some of the stabilizing members, the mounting assemblies each comprising a bearing that is slidably mounted to one of the stabilizing members.

2. The seat assembly of claim 1, wherein the passenger support member is slideably mounted to the plurality of stabilizing members.

3. The seat assembly of claim 1, wherein the plurality of stabilizing members comprises a plurality of generally vertically extending members.

4. The seat assembly of claim 1, wherein the plurality of stabilizing members are rigid.

5. The seat assembly of claim 1, wherein the plurality of stabilizing members comprises a plurality of rods.

6. The seat assembly of claim 1, wherein at least some of the inflatable actuators are selectively connectable to a pressure source.

7. The seat assembly of claim 6, wherein the plurality of spaced apart inflatable actuators comprise at least one forward inflatable actuator and at least one rearward inflatable actuator whereby the inflatable actuators are inflatable to different degrees to alter the pitch of the passenger support member.

8. The seat assembly of claim 6, wherein the plurality of spaced apart inflatable actuators comprises a plurality of forward inflatable actuators selectively connectable to the pressure source and a plurality of rearward inflatable actuators selectively connectable to the pressure source.

9. The seat assembly of claim 6, wherein the pressure source comprises a reserve tank that is selectively connectable to the inflatable actuators by a plurality of valve assemblies, the valve assemblies operatively controlled by a controller and the controller programmed to produce a rate of acceleration of the passenger support member that is based on a predetermined estimated weight of passengers supported by the passenger support member.

10. The seat assembly of claim 1, wherein each of the plurality of stabilizing members is rotatably mounted to the base about a generally horizontal axis.

11. The seat assembly of claim 1, wherein the stabilizing member extends through the bearing.

12. The seat assembly of claim 1, wherein at least some of the bearings are spherical bearings.

13. The seat assembly of claim 1, further comprising a vertical travel limiter secured to the base at a fixed distance from the base.

14. The seat assembly of claim 13, wherein the vertical travel limiter comprises a stop plate provided on at least one stabilizing member.

15. The seat assembly of claim 1, wherein the passenger support member comprises a generally horizontally extending platform to which a plurality of seats are mounted.

16. The seat assembly of claim 1, wherein the stabilizing members are not configured to allow roll motion of the passenger support member.

17. The seat assembly of claim 1, wherein the stabilizing members are configured to allow roll motion of the passenger support member.

18. The seat assembly of claim 1, wherein each stabilizing member is positioned adjacent at least one of the inflatable actuators.

19. The seat assembly of claim 1, wherein each stabilizing member is individually coupled to the passenger support member.

20. The seat assembly of claim 1, wherein the plurality of inflatable actuators comprise four inflatable actuators, and the plurality of stabilizing members comprise four stabilizing members.

* * * * *